US006118109A

United States Patent [19]

Sako

[11] Patent Number: 6,118,109

[45] Date of Patent: Sep. 12, 2000

[54] HEATING DEVICE FOR SHEET MATERIAL

[75] Inventor: Teruhisa Sako, Kyoto, Japan

[73] Assignee: Rohm Co., Ltd., Kyoto, Japan

[21] Appl. No.: 08/823,418

[22] Filed: Mar. 25, 1997

[30] Foreign Application Priority Data

Mar. 25, 1996 [JP] Japan ..... 8-067803

[51] Int. Cl.[7] ..... H05B 3/06; H05B 1/00

[52] U.S. Cl. ..... 219/542; 219/216

[58] Field of Search ..... 219/203, 543, 219/553, 542, 548; 338/322, 326

[56] References Cited

U.S. PATENT DOCUMENTS

| | | | |
|---|---|---|---|
| 4,221,672 | 9/1980 | McWilliams | 252/62 |
| 4,764,659 | 8/1988 | Minami et al. | 219/216 |
| 4,859,835 | 8/1989 | Balderson | 219/543 |
| 5,070,230 | 12/1991 | Osada | 219/203 |
| 5,196,678 | 3/1993 | Doerner | 219/542 |
| 5,282,221 | 1/1994 | Benedict | 373/128 |
| 5,371,341 | 12/1994 | Ota | 219/543 |
| 5,414,240 | 5/1995 | Carter | 219/203 |
| 5,466,488 | 11/1995 | Toyoda et al. | 427/376.2 |
| 5,470,506 | 11/1995 | Tanigami | 219/553 |
| 5,477,605 | 12/1995 | McWilliams et al. | 29/611 |
| 5,560,851 | 10/1996 | Thimm | 219/543 |
| 5,572,725 | 11/1996 | Morris et al. | 428/555 |
| 5,639,704 | 6/1997 | Inuzuka et al. | 501/127 |
| 5,759,367 | 6/1998 | Matsuura et al. | 204/424 |

FOREIGN PATENT DOCUMENTS

| | | |
|---|---|---|
| 2-59356 | 2/1990 | Japan . |
| 2-65086 | 3/1990 | Japan . |
| WO96/31089 | 3/1996 | WIPO . |

*Primary Examiner*—Teresa Walberg
*Assistant Examiner*—Daniel Robinson
*Attorney, Agent, or Firm*—Merchant & Gould P.C.

[57] ABSTRACT

A heating device includes a substrate made of a heat-resistant insulating material, a heating resistor formed on the substrate, and a protective glass coating formed on the substrate to cover the heating resistor. The protective glass coating is formed of a glass material containing, as an additive, 3~40 wt % of alumina powder which has an average grain size of 0.5~2.0 $\mu$m.

12 Claims, 4 Drawing Sheets

HEATING DEVICE FOR SHEET MATERIAL

BACKGROUND OF THE INVENTION

1. Field of the Invention

The present invention relates to a heating device for fixing electrostatically deposited toner on a paper sheet in a photocopying machine, or for heating a plastic sheet for a film laminating machine.

2. Description of the Related Art

Heating devices used for the above purposes are disclosed in Japanese Patent Application Laid-open No. 2-59356 or in Japanese Patent Application Laid-open No. 2-65086 for example. Such a heating device includes a strip-like heating resistor formed on a substrate made of a heat-resistant insulating material such as ceramic for example, and a protective glass coating formed on the substrate to cover the heating resistor layer. Typically, the protective glass coating is designed to withstand the heat generated at the heating resistor for electrical insulation while also preventing the heating resistor from being worn out due to direct contact with a sheet material.

In such a heating device, it is necessary to insure a sufficient electrical insulation, since a considerably large current is passed through the heating resistor layer to generate Joule heat for heating the sheet material. However, a conventional glass material used for the protective glass coating generally has a dielectric strength of only about 14–15 volts per a thickness of 1 $\mu$m. Thus, it is necessary to make the thickness of the protective glass coating considerably large for insuring a sufficient electric insulation. As a result, in the conventional heating device, the heat capacity of the protective glass coating becomes large, so that the thermal response at the surface of the protective glass coating is likely to deteriorate (the temperature rises slowly). If, to compensate for this, the amount of the heat generated at the heating resistor is increased, a problem of wasting energy will occur due to low thermal efficiency.

In view of the above problem, PCT Publication No. WO96/31089 (corresponding to U.S. patent application Ser. No. 08/732,351 filed Mar. 25, 1996) discloses a heating device which incorporates a protective glass coating containing an alumina powder filler in a proportion of 3~30 wt %. The alumina powder filler has an average grain size of up to 5 $\mu$m. The addition of the alumina powder as a filler doubles the dielectric strength of the protective glass coating per unit thickness when compared with a protective glass coating which does not contain any alumina powder. Thus, the protective glass coating may be considerably reduced in thickness for improving the thermal response (namely, heat transmission) of the glass coating.

However, it has been experimentally found that the dielectric strength of the protective glass coating no longer increases even if the alumina powder is added in excess of 30 wt %. In fact, the dielectric strength of the protective glass coating starts decreasing when the alumina powder is added beyond 30 wt %.

The inventor of the present invention has carried out research as to causes for the lowering of dielectric strength when the alumina powder is added in excess of 30 wt %. As a result, the inventor has found that the dielectric strength decrease is attributable to foams trapped in the glass coating, as illustrated in FIG. 6 of the accompanying drawings. In FIG. 6, reference character A designates alumina grains, whereas the foams are denoted by reference character B.

More specifically, if the content of the alumina powder is increased beyond 30 wt %, the apparent fluidity of the glass material lowers because the softening point of alumina is higher than that of the glass material, so that the lowered fluidity of the glass material hinders escape of gas. Further, when the grain size of the added alumina powder is as large as 5 $\mu$m, inside gas tends to stay in the shade of the alumina grains.

Moreover, when alumina power having a relatively large grain size is added in excess of 30 wt %, part of the alumina grains are exposed at the surface of the protective glass coating, as also shown in FIG. 6. As a result, the surface of the glass coating is roughened and fails to provide smooth contact with a sheet material.

SUMMARY OF THE INVENTION

It is, therefore, an object of the present invention to provide a heating device wherein a protective glass coating is made to have a smooth surface even if it contains an increased amount of alumina powder, thereby additionally enhancing the electrical insulation of the protective glass coating.

Another object of the present invention is to provide a process for conveniently making such a heating device.

According to one aspect of the present invention, there is provided a heating device comprising: a substrate made of a heat-resistant insulating material; a heating resistor formed on the substrate; and a protective glass coating formed on the substrate to cover the heating resistor; wherein the protective glass coating is formed of a glass material containing 3~40 wt % of alumina powder as an additive, the alumina powder having an average grain size of 0.5~2.0 $\mu$m.

It has been found that when the average grain size of the alumina powder is reduced to 0.5~2.0 $\mu$m, gas generated inside the glass coating at the time of baking can readily escape out of the coating. Thus, even if the content of the alumina powder is increased to 30 wt % or more, foams are not trapped in the glass coating, so that the dielectric strength of the glass coating can be correspondingly enhanced. However, if the content of the alumina powder is increased above 40 wt %, the apparent fluidity of the glass material during baking lowers to hinder gas escape, and the surface of the glass coating is roughened. Thus, the alumina powder should be preferably contained in the glass material in a proportion of 30~40 wt %.

Further, it is advantageous if the softening point of the glass material is lowered to a range of 580~630° C. For this purpose, the glass material may contain PbO and $B_2O_3$ both of which are found to lower the softening point of the glass material. In this regard, it has been found that PbO serves to increase the linear expansion coefficient of the protective glass coating, whereas $B_2O_3$ functions to lower the linear expansion coefficient. Thus, by suitably selecting the mixture ratio between PbO and $B_2O_3$, it is possible to adjust the linear expansion coefficient of the protective glass coating to conform to that of the substrate, thereby preventing the heating device from warping due to difference in thermal expansion between the glass coating and the substrate.

In a preferred embodiment, the heating resistor has a strip-like form. Further, the substrate is formed with a first terminal electrode at one end as well as a second terminal electrode adjacent to the first terminal electrode, the strip-like heating resistor extending from the first terminal electrode toward an opposite end of the substrate and then backward to the second terminal electrode for connection thereto.

According to another aspect of the present invention, there is provided a process for making a heating device comprising the steps of: forming a heating resistor on a substrate made of a heat-resistant insulating material; and forming a protective glass coating on the substrate to cover the heating resistor; wherein the protective glass coating is formed by the steps of preparing a glass paste by mixing a glass material with 3~40 wt % of alumina powder having an average grain size of 0.5~2.0 $\mu$m, printing the glass paste on the substrate, and baking the printed glass paste.

Again, the alumina powder may be preferably mixed with the glass material in a proportion of 30~40 wt %. Further, the softening point of the glass material may be advantageously lowered to a range of 580~630° C. by inclusion of PbO and $B_2O_3$ for instance. Moreover, the mixture ratio between PbO and $B_2O_3$ may be so adjusted that the protective glass coating has a linear thermal expansion coefficient of $55\times10^{-7}$~$70\times10^{-7}$/K.

Other objects, features and advantages of the present invention will be apparent from the detailed description of the embodiment given below with reference to the accompanying drawings.

BRIEF DESCRIPTION OF THE DRAWINGS

In the accompanying drawings:

FIG. 1 is a perspective view similar to FIG. 5 but showing the manner of performing a dielectric breakdown test.

DETAILED DESCRIPTION OF THE PREFERRED EMBODIMENTS

The preferred embodiment of the present invention will be described below with reference to the accompanying drawings.

Figure 1:
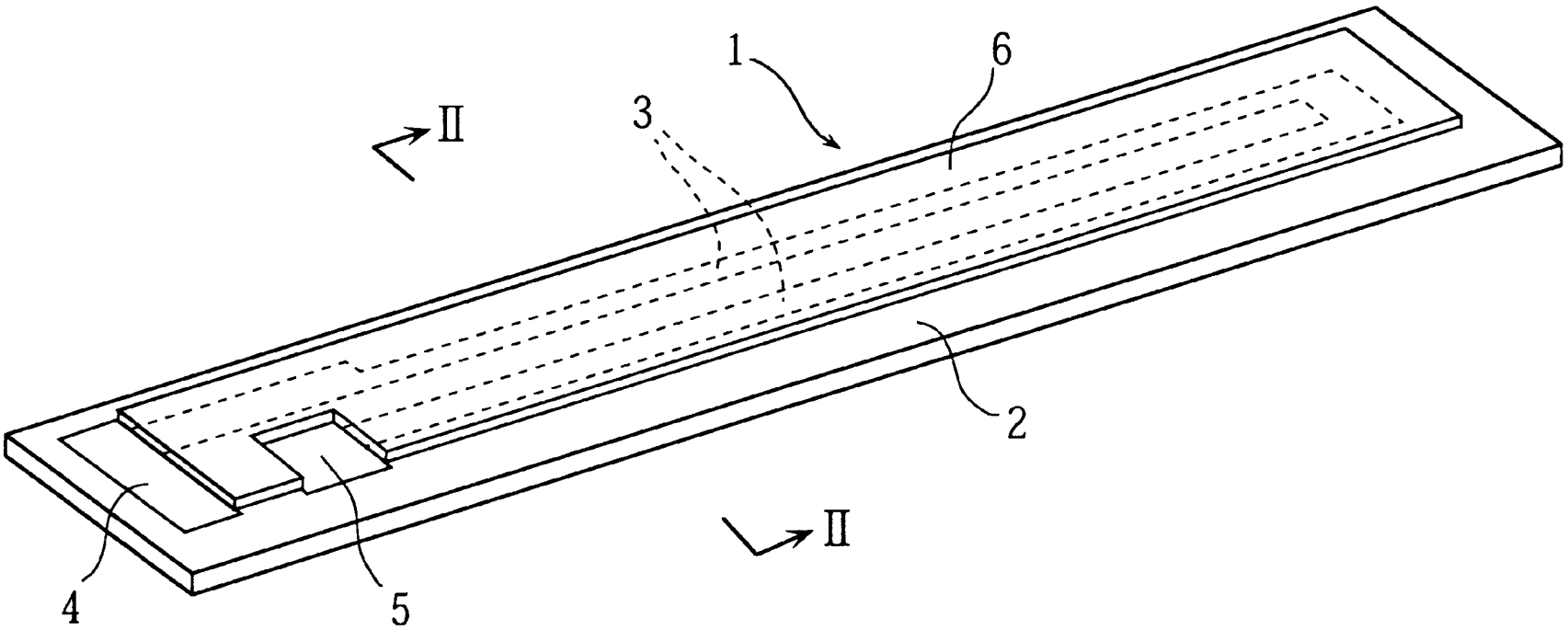
FIG. 1 is a perspective view showing a heating device according to an embodiment of the present invention.
Figure 2:
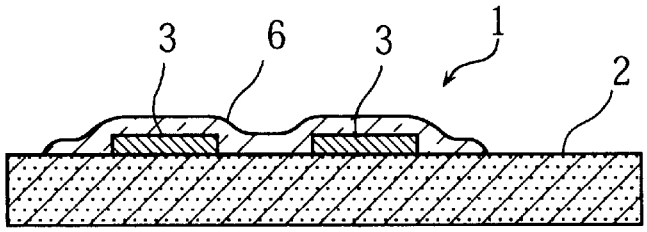
FIG. 2 is a sectional view taken on lines II—II in FIG. 1.

In FIGS. 1 and 2, reference number 1 generally indicates a heating device embodying the present invention. The heating device 1 includes an elongated strip-like substrate 2 made of a heat-resistant insulating material such as alumina ceramic for example. The substrate 2 has a surface formed with a strip-like heating resistor layer 3 made by printing a silver-palladium (Ag—Pd) paste or a ruthenium oxide paste in a thick film. Further, the surface of the substrate 2 is formed with a first terminal electrode 4 at one end of the substrate 2, and a second terminal electrode 5 adjacent to the first terminal electrode 4. The two terminal electrodes 4, 5 are equally made of an electrically conductive paste such as a silver paste.

The strip-like heating resistor layer 3 extends from the first terminal electrode 4 toward the other end of the substrate 2, and then makes a U-turn for extension to the second terminal electrode 5. The surface of the substrate 2 is additionally formed with a protective glass coating 6 for covering the heating resistor layer 3 as a whole. However, both the first and second terminal electrodes 4, 5 are exposed for electrical connection to an external power source (not shown).

In use, the unillustrated external power source provides a predetermined voltage between both terminal electrodes 4, 5 to pass a current through the strip-like heating resistor layer 3 for heat generation. A sheet material to be heated (not shown) is brought into contact with the protective glass coating 6 for performing a predetermined thermal treatment to the sheet material. For instance, when utilizing the heating device 1 as a fixing heater for a photocopying machine, a paper sheet is fed in contact with the protective glass coating 6 so that toner deposited on the sheet is fixed. In the course of the heating operation, a temperature sensor (not shown) mounted on the substrate 2 monitors the heating condition for controlling the power supply to the heating device 1.

In general, the protective glass coating 6 is required to have a good electrical insulation, a high surface smoothness and a high heat transmission. A good electrical insulation is necessary because a relatively high current is passed through the heating resistor layer 3 for generating a large amount of Joule heat. A high surface smoothness is needed for enabling the heated sheet material to be smoothly fed in contact with the glass coating 6. A high heat transmission is necessary for shortening the warm-up time, i.e., for enhancing the heat response.

Figure 3:
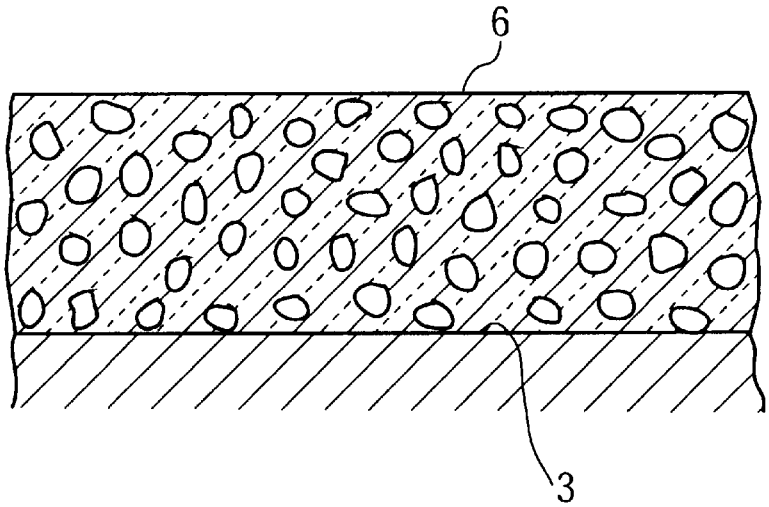
FIG. 3 is an enlarged fragmentary sectional view showing the inside structure of the protective glass coating incorporated in the heating device.

In view of the above-described general requirements, the glass material for making the protective glass coating 6 is made to contain alumina powder filler ($\alpha$-$Al_2O_3$ powder filler) having an average grain size of 0.5~2.0 $\mu$m. The proportion of the alumina powder filler in the glass material is 3~40 wt %, preferably 30–40 wt %. Since alumina has a melting point which is far higher than the softening point of glass, the alumina filler contained in the protective glass coating 6 maintains its powder state, as clearly shown in FIG. 3.

Preferably, the glass material used for the protective glass coating 6 has a softening point of 580~630° C. which is lower than the softening point of a glass material normally used for such a protective glass coating. Specifically, use may be made of a low softening point glass such as $SiO_2$—PbO—$B_2O_3$ glass.

The glass material may also contain other glass components such as $Al_2O_3$ or additives such as pigment for example. However, alumina ($Al_2O_3$) as a glass component should not be confused with the alumina powder filler. Specifically, alumina as a component of glass is incorporated into the glass structure in a molten state when heated to a temperature higher than the melting point of alumina in producing the glass, whereas the alumina powder filler retains its powder state and is not incorporated in the glass structure.

Figure 4:
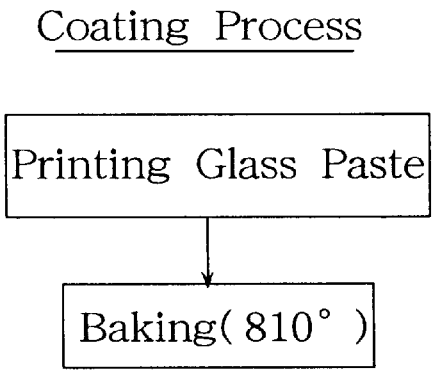
FIG. 4 is a flow diagram showing the steps of making the heating device.

The protective glass coating 6 may be formed by a thick-film printing method (see FIG. 4). Specifically, glass frit as a glass material is mixed with alumina powder filler in a solvent to prepare a glass paste which is deposited onto the substrate 2 with a thickness of e.g. 30 $\mu$m by screen-printing to cover the heating resistor 3. Then, the substrate 2 together with the deposited glass paste is placed in an oven and backed at 810° C. for example.

In the course of the baking step, the solvent in the deposited glass paste evaporates while the glass material (frit) fluidizes. At this time, since the softening point of the glass material is lowered due to the inclusion of PbO and/or $B_2O_3$, the fluidity of the glass material can be made relatively high. Further, since the alumina powder added as a filler has a relatively small average size of 0.5~2.0 $\mu$m, the powder grains can be easily wrapped by the highly fluidized glass while allowing ready escape of gas generated by evaporation of the solvent. Moreover, due to the small size of the powder grains, it is unlikely that the powder grains are partially exposed at the surface portion of the fluidized glass. As a result, the protective glass coating 6 can be made to have a high insulating ability, a good thermal conductivity and a high surface smoothness.

More specifically, since the alumina powder filler is added at a high proportion of 30~40 wt %, the protective glass coating 6 can be made to have a high electrical insulation per unit thickness. Further, due to the relatively small size of the alumina powder grains, foams do not remain in the protective glass coating 6, so that a deterioration of electrical insulation resulting from such foams can be avoided.

On the other hand, the increase of electrical insulation allows a thickness reduction of the protective glass coating 6. Thus, the heat transmission (namely, thermal response) of the protective glass coating 6 can be correspondingly enhanced. In this regard, alumina as a powder filler has a relatively high thermal conductivity, so that the addition per se of the alumina powder filler also enhances the heat transmission of the protective glass coating 6. For example, the thermal conductivity of the protective glass coating 6 can be increased to $3.0\times10^{-3}$~$6.0\times10^{-3}$ cal/cm•s•K (about $1.26\times10^{-2}$~$2.52\times10^{-2}$ J/cm•s•K) by increasing the proportion of the alumina powder to no less than 30 wt %, as opposed to $1.5\times10^{-3}$~$2.5\times10^{31\ 3}$ cal/cm•s•K (about $6.3\times10^{-3}$~$1.05\times10^{-2}$ J/cm•s•K) exhibited by a conventional glass material for a protective glass coating.

As previously described, the softening point of the glass material is lowered due to the inclusion of PbO and/or $B_2O_3$. These compounds have been found to have no crystallizing effect, as opposed to an alkaline metal (e.g. K, Na) or an alkaline-earth metal (e.g. Ca). Thus, the protective glass coating 6 containing PbO and/or $B_2O_3$ is prevented from suffering surface roughness which would result from crystallization of the glass.

Further, it has been found that PbO serves to increase the linear expansion coefficient of the glass material, whereas $B_2O_3$ serves to decrease the linear expansion coefficient of the glass material. Thus, by suitably selecting the mixture ratio between PbO and $B_2O_3$, it is possible to adjust the linear expansion coefficient of the protective glass coating 6 to closely conform to that of the substrate 2, thereby preventing warping of the heating device 1 due to difference in thermal expansion coefficient between the protective glass coating 6 and the substrate 2.

To better understand the present invention, a specific example of the present invention is given below together with a comparative example.

EXAMPLE

In the heating device 1 illustrated in FIGS. 1 and 2, the protective glass coating 6 was formed by applying and baking a glass a glass paste. The glass paste was prepared by adding a alumina powder filler to material having the composition shown in Table 1 below.

TABLE 1

| Glass Component | Proportion (wt %) |
|---|---|
| $B_2O_3$ | 10 |
| PbO | 60 |
| $SiO_2$ | 20 |
| $Al_2O_3$ | 10 |

The glass material shown in Table 1 had a softening point of 580° C. before addition of the alumina powder filler. It should be appreciated that $Al_2O_3$ listed in Table 1 was one of the glass components forming the glass structure.

The alumina powder filler was $\alpha$-$Al_2O_3$ powder having an average grain size of 0.8~1.3 $\mu$m. The proportion of the added $\alpha$-$Al_2O_3$ powder was 35 wt %.

The prepared glass paste was applied by screen-printing and baked at 810° C. The resulting protective glass coating 6 had a thickness of 45 $\mu$m and a linear expansion coefficient of $65\times10^{-7}$/K which was nearly equal to the linear expansion coefficient of the insulating substrate 2. Further, the protective glass coating 6 had a surface roughness Rz of 0.6 $\mu$m which was considered sufficiently smooth.

Figure 5:
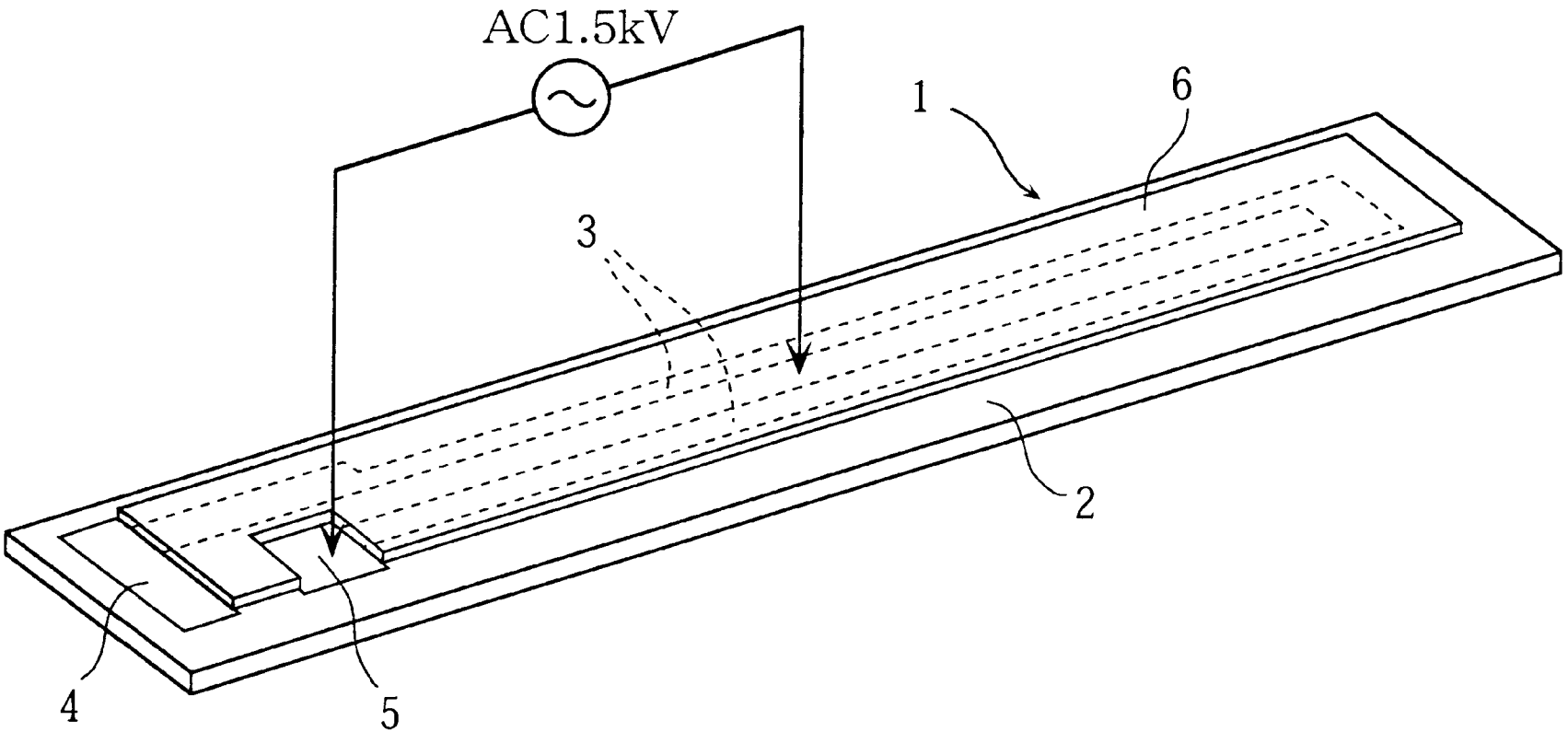
Figure 6:
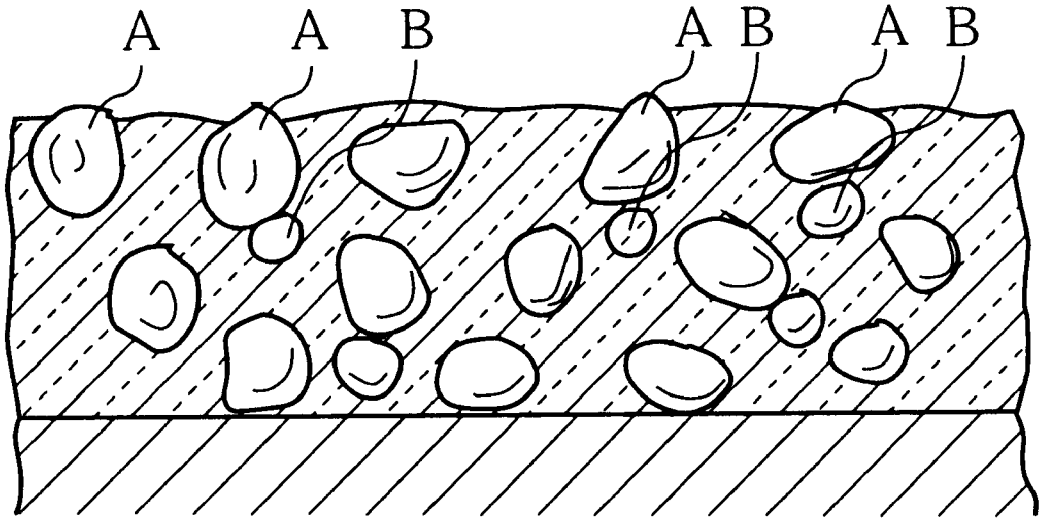
FIG. 6 is an enlarged fragmentary sectional view showing the inside structure of the protective glass coating when the average size of alumina powder is increased.

For testing the electrical insulating ability of the protective glass coating 6, an alternating voltage of 1.5 Kv was applied for three seconds across one of the terminal electrodes 4, 5 and the surface of the protective glass coating 6, as illustrated in FIG. 5. For statistical purposes, the same insulation test was repeated with respect to other heating devices which were similarly made. As a result, it was found that only 2% of the tested products suffered dielectric breakdown.

[Comparison]

In place of the glass paste used in the foregoing example, a glass paste was prepared by adding a alumina powder filler to a glass material having the composition shown in Table 2 below.

TABLE 2

| Glass Component | Proportion (wt %) |
|---|---|
| PbO | 50 |
| $SiO_2$ | 22 |
| $Al_2O_3$ | 20 |
| MgO + CaO | 8 |

The alumina powder filler was $\alpha$-$Al_2O_3$ powder having an average grain size of 5 $\mu$m. The proportion of the added $\alpha$-$Al_2O_3$ powder was 20 wt %.

The prepared glass paste was applied and baked at 810° C. The resulting protective glass coating had a thickness of 45 $\mu$m and a linear expansion coefficient of $63\times10^{-7}$/K.

For testing the electrical insulating ability of the protective glass coating, the same test as shown in FIG. 5 was performed with respect to a plurality of similarly made products. As a result, it was found that 10% of the tested products suffered dielectric breakdown.

The present invention being thus described, it is obvious that the same may be varied in many ways. For instance, the specific composition of the glass material may be selected depending on the intended characteristics of the protective glass coating. Such variations should not be regarded as a departure from the spirit and scope of the present invention, and all such modifications as would be obvious to those skilled in the art are intended to be included within the scope of the following claims.

What is claimed is:

1. A heating device comprising:

a substrate made of a heat-resistant insulating material;

a heating resistor formed on the substrate; and a protective glass coating formed on the substrate to cover the heating resistor;

wherein the protective glass coating is formed of a glass material containing 3~40 wt % of alumina powder as an additive, the alumina powder retaining a powder state in the protective glass coating while also having an average grain size of 0.5~2.0 $\mu$m.

2. The heating device according to claim 1, wherein the alumina powder is contained in the glass material in a proportion of 30~40 wt %.

3. The heating device according to claim 1, wherein the glass material has a softening point of 580~630° C.

4. The heating device according to claim 2, wherein the glass material contains PbO and $B_2O_3$.

5. The heating device according to claim 1, wherein the protective glass coating is generally equal in linear thermal expansion coefficient to the substrate.

6. The heating device according to claim 1, wherein the heating resistor has a strip-like form.

7. The heating device according to claim 6, wherein the substrate is formed with a first terminal electrode at one end as well as a second terminal electrode adjacent to the first terminal electrode, the strip-like heating resistor extending from the first terminal electrode toward an opposite end of the substrate and then back to the second terminal electrode for connection thereto.

8. A process for making a heating device comprising the steps of:

forming a heating resistor on a substrate made of a heat-resistant insulating material; and forming a protective glass coating on the substrate to cover the heating resistor;

wherein the protective glass coating is formed by the steps of preparing a glass paste by mixing a glass material with 3~40 wt % of alumina powder having an average grain size of 0.5~2.0 $\mu$m, printing the glass paste on the substrate, and baking the printed glass paste so that the alumina powder retains a powder state in the protective glass coating.

9. The process according to claim 8, wherein the alumina powder is mixed with the glass material in a proportion of 30~40 wt %.

10. The process according to claim 8, wherein the glass material has a softening point of 580~630° C.

11. The process according to claim 10, wherein the glass material contains PbO and $B_2O_3$.

12. The process according to claim 11, wherein PbO and $B_2O_3$ are contained in the glass material in an adjusted ratio so that the protective glass coating has a linear thermal expansion coefficient of $55\times10^{-7}$~$70\times10^{-7}$/K.

* * * * *